US010128556B2

(12) United States Patent
Ligander et al.

(10) Patent No.: US 10,128,556 B2
(45) Date of Patent: Nov. 13, 2018

(54) TRANSITION BETWEEN A SIW AND A WAVEGUIDE INTERFACE

(71) Applicant: Telefonaktiebolaget L M Ericsson (publ), Stockholm (SE)

(72) Inventors: Per Ligander, Göteborg (SE); Valter Pasku, Libofshé (AL); Ove Persson, Hunnebostrand (SE); Pietro Sanchirico, Corciano (IT); Ola Tageman, Göteborg (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 60 days.

(21) Appl. No.: 14/779,217

(22) PCT Filed: Mar. 24, 2013

(86) PCT No.: PCT/EP2013/056174
§ 371 (c)(1),
(2) Date: Sep. 22, 2015

(87) PCT Pub. No.: WO2014/154232
PCT Pub. Date: Oct. 2, 2014

(65) Prior Publication Data

US 2016/0049714 A1 Feb. 18, 2016

(51) Int. Cl.
*H01P 5/08* (2006.01)
*H01P 3/12* (2006.01)

(52) U.S. Cl.
CPC ..... *H01P 5/08* (2013.01); *H01P 3/121* (2013.01); *H01P 5/082* (2013.01)

(58) Field of Classification Search
CPC ..... H01P 5/08
(Continued)

(56) References Cited

U.S. PATENT DOCUMENTS 2,724,805 A * 11/1955 Smullin ..... H01P 5/04 333/208
4,041,420 A * 8/1977 Riblet ..... H01P 5/024 333/252

(Continued)

FOREIGN PATENT DOCUMENTS

DE 19621809 A1 12/1997

OTHER PUBLICATIONS

Kai, T., et al., "Transformer between a thin post-wall waveguide to a standard metal waveguide", 2002 Digest, IEEE Antennas and Propagation Society International Symposium: Jun. 16-21, 2002, San Antonio, Texas; [IEEE Antennas and Propagation Society International Symposium], IEEE Operations Center, Piscataway, NJ, vol. 4, Jun. 16, 2002, pp. 436-439, XP010592459.

(Continued)

*Primary Examiner* — Stephen E Jones
*Assistant Examiner* — Scott S Outten
(74) *Attorney, Agent, or Firm* — Patent Portfolio Builders, PLLC

(57) ABSTRACT

The present invention relates to a transition arrangement (1) between a SIW and a waveguide interface (3). The SIW comprises a dielectric material (4), a first and second metal layer (5, 6) and a first and second electric wall element (7*a*, 7*b*) running essentially parallel and electrically connecting the metal layers (5, 6). The transition arrangement (1) comprises a coupling aperture (8) in the first metal layer (5) and a third wall element (7*c*) running between the first and second electric wall elements (7*a*, 7*b*). The transition arrangement (1) further comprises an intermediate transition element (9) with a first and second main surface (10, 11), and a transition aperture (12) having first and second opening (13, 14) with corresponding first and second widths ($w_1$, $w_2$). The transition element (9) is mounted over the coupling (Continued)

Section C-C aperture (8), the first width ($w_1$) exceeding the second width ($w_2$) and the transition from the first width ($w_1$) to the second width ($w_2$) taking place between the first opening (13) and the second opening (14) in at least one step (15, 16). The second opening (14) is mounted to the waveguide interface (3) having an interface opening (17) being offset relative the second opening (14), a front step (18) being formed.

8 Claims, 4 Drawing Sheets

(58) Field of Classification Search
USPC ..... 333/21 R
See application file for complete search history.

(56) References Cited

U.S. PATENT DOCUMENTS 6,137,383 A * 10/2000 De Lillo ..... H01P 1/219 333/203
2004/0032305 A1* 2/2004 Bohnet ..... H01P 1/165 333/21 A
2004/0145426 A1 7/2004 Wu et al.
2006/0274992 A1* 12/2006 Shimura ..... H01P 5/08 385/14
2008/0186113 A1* 8/2008 Hoover ..... H01P 1/02 333/249

OTHER PUBLICATIONS

Lee, J. et al., "Transition to a High Dielectric Constant Post Wall Waveguide from a Standard waveguide by using a Hollow Cavity in a Laminated Substrate", Antennas and Propagation Society Internation Symposium 2006, IEEE Albuquerque, NM, USA Jul. 9-14, 2006, Piscataway, NJ, USA, IEEE Piscataway, NJ, USA, Jul. 9, 2006, pp. 1613-1616, XP010944164.
Kai, T., et al., "A Stepped post-wall waveguide with aperture interface to standard waveguide", Antennas and Propagation Society Symposium, 2004, IEEE Monterey, CA, USA, Jun. 20-25, 2004, Piscataway, NJ, USA, IEEE, vol. 2, Jun. 20, 2004, pp. 1527-1530, XP010721635.
Zhang, Q., et al., "E-band "T" shape Transitions between Substrate Integrated Waveguide and Standard Waveguide", Microwave Conference, 2008, APM 2008, Asia-Pacific, IEEE, Piscataway, NJ, USA, Dec. 16, 2008, pp. 1-4, XP031636749.

* cited by examiner

Section A-A

Section B-B

Section C-C

TRANSITION BETWEEN A SIW AND A WAVEGUIDE INTERFACE

CROSS-REFERENCE TO RELATED APPLICATION

This application is a 35 U.S.C. § 371 National Phase Entry Application from PCT/EP2013/056174, filed Mar. 24, 2013, and designating the United States.

TECHNICAL FIELD

The present invention relates to a transition arrangement adapted to provide a signal transition between a substrate integrated waveguide, SIW, to a waveguide interface. The SIW comprises a dielectric material, a first metal layer, a second metal layer and an electric wall element arrangement, the dielectric materiel having a layer thickness and being positioned between the first metal layer and the second metal layer. The electric wall element arrangement comprises a first electric wall element and a second electric wall element, the first electric wall element and the second electric wall element at least partly running mutually parallel, separated by a SIW width in a SIW longitudinal extension and electrically connecting the first metal layer with the second metal layer. Microwave signals are arranged to propagate along the SIW longitudinal extension in a confinement limited by at least the first metal layer, the second metal layer, the first electric wall element and the second wall element. The transition arrangement comprises a coupling aperture in the first metal layer and a third wall element running between the first electric wall element and the second wall element, across the SIW longitudinal extension.

BACKGROUND

A waveguide interface between different function blocks, and between a function block and test equipment, is needed in many situations in microwave technology. Antennas, duplex filters, and amplifiers are examples of such function blocks, and the test equipment may be constituted by any type of suitable measuring or test device.

One of these function blocks is in this context constituted by a so-called substrate integrated waveguide SIW, and there is a need for an enhanced transition from an air-filled waveguide to a SIW. The following properties are found to be of importance:

- Mechanically Robust
- Lightweight
- Low cost
- Wide band
- Robust to fabrication tolerances
- Low loss
- Good matching
- Millimeter wave range functionality, i.e. for frequencies about 30-300 GHz, in particular 60 and 70/80 GHz.

Different types of transitions have been made, but none of them have provided a sufficient band width, robustness and low loss, and thus an enhanced transition between a SIW and a waveguide interface is desired.

SUMMARY

It is an object of the present invention to provide a transition between a SIW and a waveguide interface which provides enhanced functionality with respect to the properties listed above, in particular band width, robustness and low loss.

Said object is obtained by means of a transition arrangement adapted to provide a signal transition between a substrate integrated waveguide, SIW, to a waveguide interface. The SIW comprises a dielectric material, a first metal layer, a second metal layer and an electric wall element arrangement, the dielectric materiel having a layer thickness and being positioned between the first metal layer and the second metal layer. The electric wall element arrangement comprises a first electric wall element and a second electric wall element, the first electric wall element and the second electric wall element at least partly running mutually parallel, separated by a SIW width in a SIW longitudinal extension and electrically connecting the first metal layer with the second metal layer. Microwave signals are arranged to propagate along the SIW longitudinal extension in a confinement limited by at least the first metal layer, the second metal layer, the first electric wall element and the second wall element. The transition arrangement comprises a coupling aperture in the first metal layer and a third wall element running between the first electric wall element and the second wall element, across the SIW longitudinal extension.

The transition arrangement further comprises an at least partly electrically conducting intermediate transition element which in turn comprises a first main surface, a second main surface and a transition aperture. The transition aperture comprises a first opening with a first width in the first main surface, and a second opening with a second width in the second main surface, the widths extending along the SIW longitudinal extension. The transition element is mounted to the first metal layer such that the first opening faces, and at least partly covers, the coupling aperture, the first width exceeding the second width. Furthermore, the transition from the first width to the second width takes place between the first opening and the second opening in at least one step. The second opening faces, and is mounted to, the waveguide interface, such that a waveguide interface opening partly covers the second opening. The waveguide interface opening is offset relative the second opening towards the third wall element such that a front step is formed on a part of the second main surface that falls within the waveguide interface opening.

According to an example, the waveguide interface has an interface surface that faces to, and makes electrical contact with, the second main surface. Then, the waveguide interface opening is offset relative the second opening towards the third wall element such that a part of the interface surface covers a part of the second opening that faces away from the third wall element. An overlap step is then formed by said part of the interface surface.

According to another example, the electric wall element arrangement either comprises a plurality of via connections, or plated slots running through the dielectric material, electrically connecting the first metal layer to the second metal layer.

Other examples are disclosed in the dependent claims.

A number of advantages are obtained by means of the present invention:

- Small size
- Lightweight, since the volume is small
- Low cost, since assembly may be made with standard pick & place assembly process or with guiding pins
- No machining needed in board, only single side machining in adapter Wide band, relaxing tolerance requirements
Lowered loss
Enhanced matching and bandwidth properties
Millimeter wave capable, 30-300 GHz, in particular 60 and 70/80 GHz
Mechanically robust

BRIEF DESCRIPTION OF THE DRAWINGS

The present invention will now be described more in detail with reference to the appended drawings, where.

DETAILED DESCRIPTION

Figure 1:
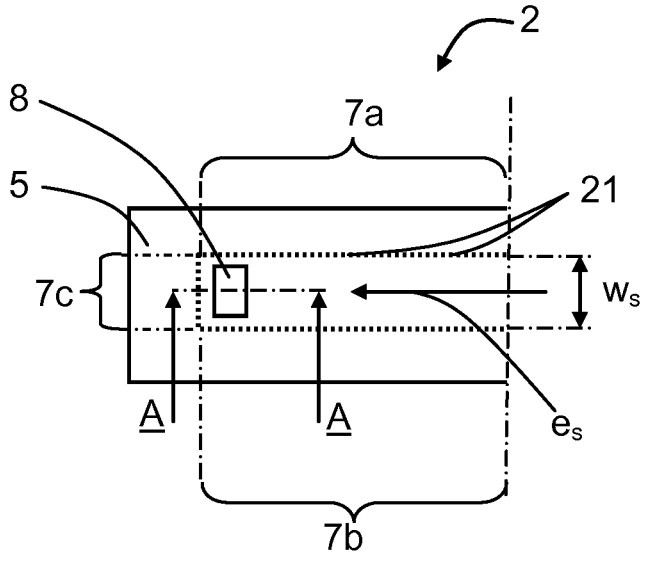
FIG. 1 schematically shows a top view of a SIW with a coupling aperture.
Figure 2:
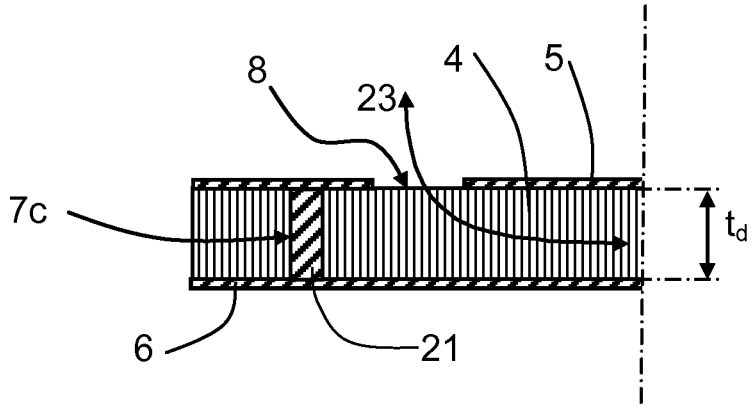
FIG. 2 schematically shows a sectional side view of FIG. 1.

With reference to FIG. 1 and FIG. 2, a substrate integrated waveguide, a SIW, is a waveguide defined by at least two parallel walls located in the dielectric between two electrically conductive layers.

More in detail, the SIW 2 comprises a dielectric material 4, a first metal layer 5 and a second metal layer 6, where the dielectric materiel 4 has a layer thickness $t_d$ and is positioned between the first metal layer 5 and the second metal layer 6. The SIW also comprises an electric wall element arrangement 7*a*, 7*b*, 7*c* in the form of vias 21 that run through the dielectric material 4 and electrically connect the metal layers 5, 6. The electric wall element arrangement comprises a first electric wall element 7*a* and a second electric wall element 7*b*, where the first electric wall element 7*a* and the second electric wall element 7*b* run mutually parallel, separated by a SIW width $w_s$ in a SIW longitudinal extension $e_s$.

Microwave signals 23 are arranged to propagate along the SIW longitudinal extension $e_s$ in a confinement limited by at least the first metal layer 5, the second metal layer 6, the first electric wall element 7*a* and the second wall element 7*b*.

As a part of a transition arrangement 1 which will be described more in detail later, the SIW 2 comprises a coupling aperture 8 in the first metal layer 5, and a third wall element 7*c* also being in the form of vias 21 that run through the dielectric material 4 and electrically connect the metal layers 5, 6. The third wall element 7*c* is running between the first electric wall element 7*a* and the second wall element 7*b*, across the SIW longitudinal extension $e_s$. Microwave signals 23 propagating in the SIW are thus directed to run via the coupling aperture 8.

Figure 3:
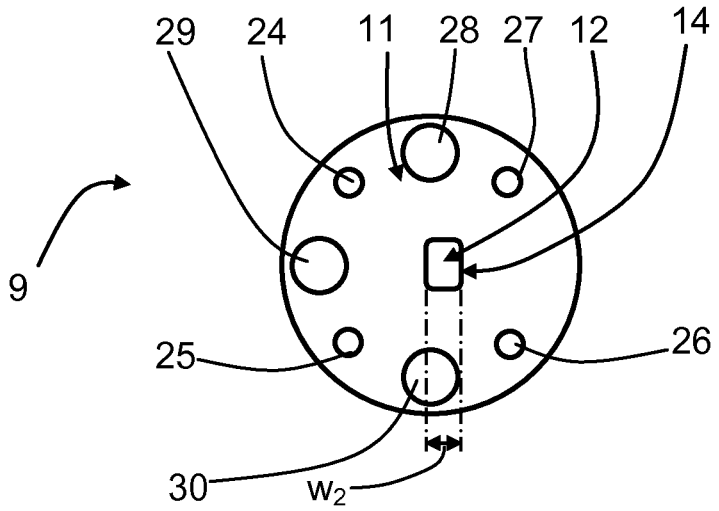
FIG. 3 schematically shows a top view of a transition element.
Figure 4:
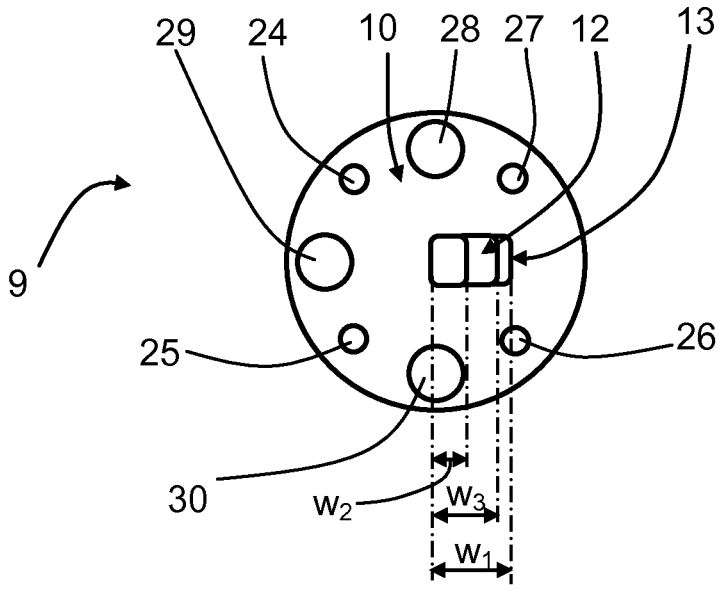
FIG. 4 schematically shows a bottom view of a transition element.

According to the present invention, with reference to FIG. 3 and FIG. 4, the transition arrangement 1 further comprises a electrically conducting intermediate transition element 9 which in turn comprises a first main surface 10, a second main surface 11 and a transition aperture 12. FIG. 3 shows a top view of the transition element 9, and FIG. 4 shows a bottom view of the transition element 9. The transition element 9 comprises guiding pin apertures 24, 25, 26, 27 and screw mount apertures 28, 29, 30.

Furthermore, as shown in FIG. 4, the transition aperture 12 comprises a first opening 13 with a first width $w_1$ in the first main surface 10, and, as shown in FIG. 3, a second opening 14 with a second width $w_2$ in the second main surface. Between the openings 13, 14 there is a first intermediate step 15 and a second intermediate step 16, the transition between the first intermediate step 15 and a second intermediate step 16 defining a third width $w_3$.

Figure 5:
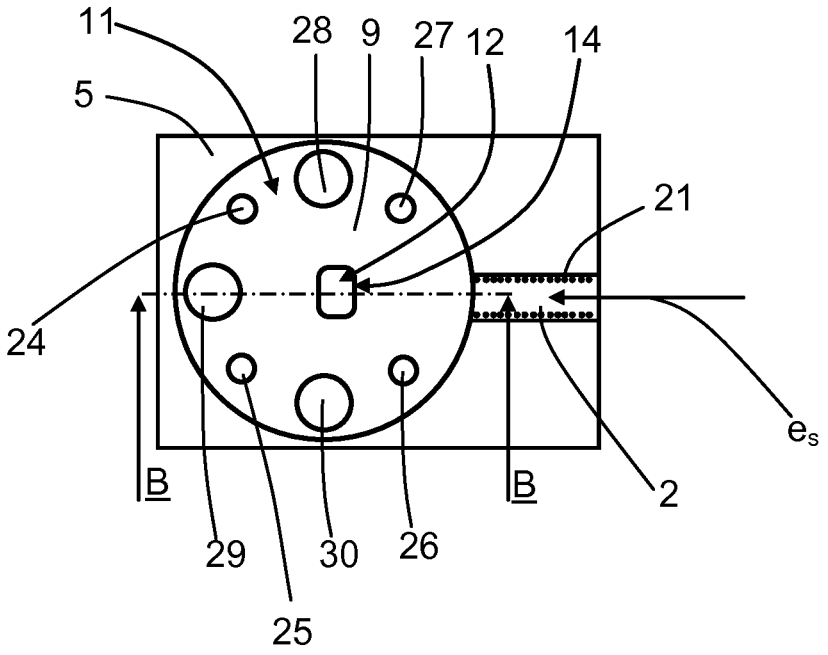
FIG. 5 schematically shows a top view of a transition element mounted to the SIW.
Figure 6:
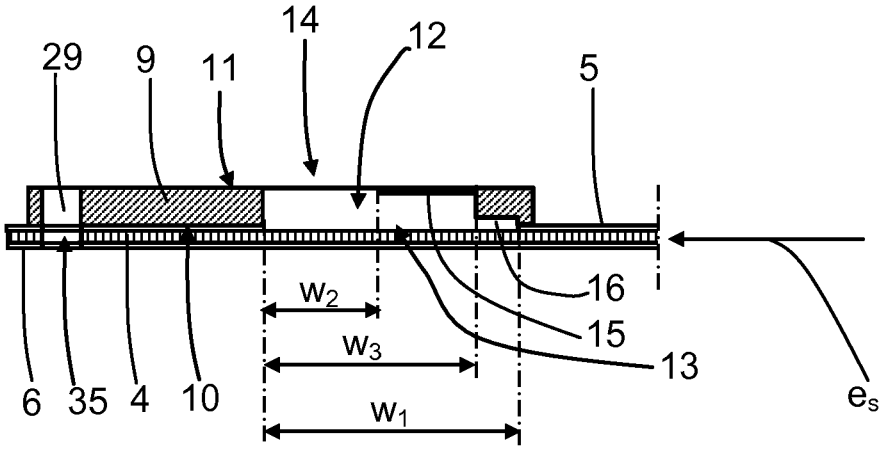
FIG. 6 schematically shows a sectional side view of FIG. 5.

The widths $w_1$, $w_2$ $w_3$ extend along the SIW longitudinal extension $e_s$, and with reference also to FIG. 5 and FIG. 6, the transition element 9 is mounted to the first metal layer 5 such that the first opening 13 faces, and covers, the coupling aperture 8. The first width $w_1$ exceeds the second width $w_2$, and the third width $w_3$ falls between the first width $w_1$ and the second width $w_2$. The transition from the first width $w_1$ to the second width $w_2$ takes place between the first opening 13 and the second opening 14 in said steps 15, 16.

Figure 7:
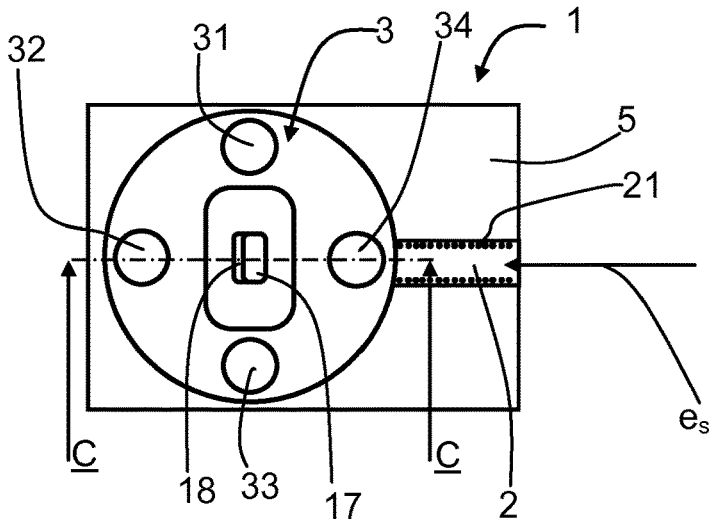
FIG. 7 schematically shows a top view of transition arrangement with a transition element mounted to the SIW and a waveguide interface mounted to the transition element.
Figure 8:
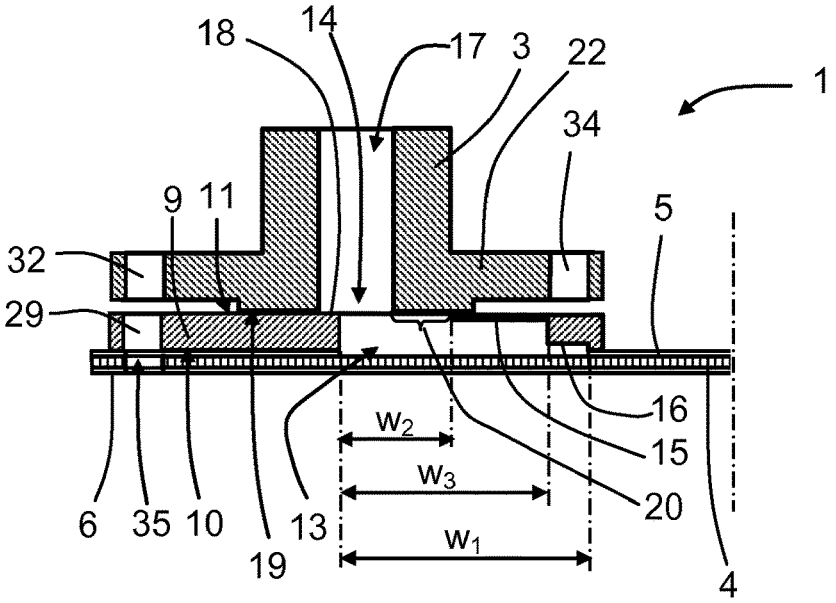
FIG. 8 schematically shows a sectional side view of FIG. 7.

As shown in FIG. 7 and FIG. 8, a waveguide interface 3 is mounted to the transition element 9, the transition element being sandwiched between the first metal layer 5 and the waveguide interface 3. The waveguide interface 3 comprises waveguide screw mount apertures 31, 32, 33, 34 in a waveguide flange 22, where the three first waveguide screw mount apertures 31, 32, 33 are arranged to co-inside with the screw mount apertures 28, 29, 30 of the transition element 9. The fourth waveguide screw mount aperture 34 is not used here due to the position of the SIW 2. Screws (not shown) are used to mount the waveguide interface 3 to the transition element 9 and the SIW dielectric material 4 with its metal layers 5, 6 via said screw mount apertures 28, 29, 30; 31, 32, 33 and corresponding apertures 35 through dielectric material 4 and its metal layers 5, 6. The waveguide flange 22 suitably comprises guiding pins (not shown) that are arranged to interact with the guiding pin apertures 24, 25, 26, 27 when the waveguide interface 3 is mounted to the transition element 9.

The second opening 14 faces, and is mounted to, the waveguide interface 3 such that a waveguide interface opening 17 partly covers the second opening 14. The waveguide interface opening 17 is offset relative the second opening 14 towards the third wall element 7*c* such that a front step 18 is formed on a part of the second main surface 11 that falls within the waveguide interface opening 17.

As shown in FIG. 8, the waveguide interface 3 has an interface surface 19 that faces to, and makes electrical contact with, the second main surface 11 of the transition element 9. The waveguide interface opening 17 is offset relative the second opening 14 towards the third wall element 7*c* such that a part of the interface surface 19 covers a part of the second opening 14 that faces away from the third wall element 7*c*. In this way, an overlap step 20 is formed by said part of the interface surface 19.

The present invention is not limited to the example described above, but may vary within the scope of the appended claims. For example, at least one of the waveguide interface 3 and the intermediate transition element 9 may be made in a metal or, alternatively, formed in a plastic material and covered by an electrically conducting coating. These elements 3, 9 are thus at least partly electrically conducting.

The electric wall element arrangement has been shown comprising a plurality of via connections. Other alternatives are possible, such as plated trenches or plated slots, running through the dielectric material 4, electrically connecting the first metal layer 5 to the second metal layer 6.

The first electric wall element 7*a* and the second electric wall element 7*b* at least partly run mutually parallel, there may be width changes for example in the form of irises or similar, the SIW width $w_s$ being changed between different values.

The transition from the first width $w_1$ to the second width $w_2$ has been shown to take place in two steps 15, 16 via the third width $w_3$, but said transition may take place in only one step. Alternatively, said transition may take place in more than two steps. Among other things, the steps 15, 16, 18, 20 provide enhanced transmission and matching properties.

The waveguide interface opening 17 does not have to be offset relative the second opening 14 towards the third wall element 7*c* as described previously. In that case, the overlap step 20 is not present.

The first intermediate step 15 is normally relative thin in comparison to the thickness of the transition element 9.

The usage of screws for mounting the transition arrangement 1 is only an example, other types of mounting is conceivable such as conductive glue, solder or press-fit.

The number of guiding pins may be any suitable, the usage of guiding pins being optional.

The transition element 9 and the waveguide interface 3 may be surface-mounted, and mounted in an ordinary pick & place process.

The waveguide interface 3 may be constituted by any suitable waveguide interface that is electromagnetically connectable to the coupling aperture 8 and with the mechanical properties needed for the present invention.

The present invention thus relates to a transition arrangement 1 adapted to provide a signal transition between a substrate integrated waveguide 2, SIW, to a waveguide interface 3. The SIW comprises a dielectric material 4, a first metal layer 5, a second metal layer 6 and an electric wall element arrangement 7*a*, 7*b*, 7*c*. The dielectric materiel 4 has a layer thickness $t_d$ and is positioned between the first metal layer 5 and the second metal layer 6.

The electric wall element arrangement comprises a first electric wall element 7*a* and a second electric wall element 7*b*, where the first electric wall element 7*a* and the second electric wall element 7*b* at least partly run mutually parallel, separated by a SIW width $w_s$ in a SIW longitudinal extension $e_s$ and electrically connecting the first metal layer 5 with the second metal layer 6. The SIW width $w_s$ may be variable along the SIW longitudinal extension $e_s$.

Microwave signals being arranged to propagate along the SIW longitudinal extension $e_s$ in a confinement limited by at least the first metal layer 5, the second metal layer 6, the first electric wall element 7*a* and the second wall element 7*b*. The transition arrangement 1 comprises a coupling aperture 8 in the first metal layer 5 and a third wall element 7*c* running between the first electric wall element 7*a* and the second wall element 7*b*, across the SIW longitudinal extension $e_s$.

The transition arrangement 1 further comprises an at least partly electrically conducting intermediate transition element 9 which in turn comprises a first main surface 10, a second main surface 11 and a transition aperture 12. The transition aperture 12 comprises a first opening 13 with a first width $w_1$ in the first main surface 10, and a second opening 14 with a second width $w_2$ in the second main surface, the widths $w_1$, $w_2$ extending along the SIW longitudinal extension $e_s$. The transition element 9 is mounted to the first metal layer 5 such that the first opening 13 faces, and at least partly covers, the coupling aperture 8. The first width $w_1$ exceeds the second width $w_2$ and the transition from the first width $w_1$ to the second width $w_2$ takes place between the first opening 13 and the second opening 14 in at least one step 15, 16. The second opening 14 faces, and is mounted to, the waveguide interface 3, such that a waveguide interface opening 17 partly covers the second opening 14, the waveguide interface opening 17 being offset relative the second opening 14 towards the third wall element 7*c* such that a front step 18 is formed on a part of the second main surface 11 that falls within the waveguide interface opening 17.

The invention claimed is:

1. An apparatus adapted to provide a signal transition between a substrate integrated waveguide (SIW) to a waveguide interface, the SIW comprising a dielectric material, a first metal layer, a second metal layer, and an electric wall element arrangement, the dielectric material having a layer thickness and being positioned between the first metal layer and the second metal layer, the electric wall element arrangement comprising a first electric wall element and a second electric wall element, the first electric wall element and the second electric wall element at least partly running mutually parallel, separated by an SIW width, in an SIW longitudinal extension and electrically connecting the first metal layer with the second metal layer, microwave signals being arranged to propagate along the SIW longitudinal extension in a confinement limited by at least the first metal layer, the second metal layer, the first electric wall element, and the second electric wall element, the apparatus comprising:

a coupling aperture in the first metal layer;

a third wall element running between the first electric wall element and the second electric wall element, across the SIW longitudinal extension; and an at least partly electrically conducting intermediate transition element comprising: a first main surface, a second main surface, and a transition aperture, wherein the transition aperture comprises a first opening with a first width in the first main surface, and a second opening with a second width in the second main surface, the first and second widths extending along the SIW longitudinal extension, the intermediate transition element is mounted to the first metal layer such that the first opening faces the coupling aperture, and at least partially covers the coupling aperture, the first width exceeds the second width, and a transition from the first width to the second width takes place between the first opening and the second opening in two steps: a first intermediate step and a second intermediate step, wherein cross-sectional thickness of the first intermediate step is lesser than cross-sectional thickness of the second intermediate step, and wherein the second opening faces the waveguide interface, and is mounted to the waveguide interface such that a waveguide interface opening partly covers the second opening, the waveguide interface opening being offset relative to the second opening towards the third wall element such that a front step is formed on a part of the second main surface that falls within the waveguide interface opening.

2. The apparatus according to claim 1, wherein the waveguide interface has an interface surface that faces to, and makes electrical contact with, the second main surface, and wherein the waveguide interface opening is offset relative to the second opening towards the third wall element such that a part of the interface surface covers a part of the second opening that faces away from the third wall element, an overlap step being formed by said part of the interface surface.

3. The apparatus according to claim 1, wherein at least one of the waveguide interface and the intermediate transition element is formed in a plastic material and is covered by an electrically conducting coating.

4. The apparatus according to claim 1, wherein the waveguide interface comprises a waveguide flange that is attached to the intermediate transition element by means of screws.

5. The apparatus according to claim 1, wherein the electric wall element arrangement comprises a plurality of via connections electrically connecting the first metal layer to the second metal layer.

6. The apparatus according to claim 1, wherein the electric wall element arrangement comprises plated slots running through the dielectric material, electrically connecting the first metal layer to the second metal layer.

7. An apparatus adapted to provide a signal transition between a substrate integrated waveguide (SIW) to a waveguide interface, the SIW comprising a dielectric material, a first metal layer, a second metal layer, and an electric wall element arrangement, the dielectric material having a layer thickness and being positioned between the first metal layer and the second metal layer, the electric wall element arrangement comprising a first electric wall element and a second electric wall element, the first electric wall element and the second electric wall element at least partly running mutually parallel, separated by an SIW width, in an SIW longitudinal extension and electrically connecting the first metal layer with the second metal layer, microwave signals being arranged to propagate along the SIW longitudinal extension in a confinement limited by at least the first metal layer, the second metal layer, the first electric wall element, and the second electric wall element, the apparatus comprising:

a coupling aperture in the first metal layer;

a third wall element running between the first electric wall element and the second electric wall element, across the SIW longitudinal extension;

an at least partly electrically conducting intermediate transition element comprising: a first main surface, a second main surface, and a transition aperture;

the transition aperture comprises a first opening with a first width in the first main surface, and a second opening with a second width in the second main surface, the first and second widths extending along the SIW longitudinal extension, wherein a transition from the first width to the second width takes place between the first opening and the second opening in two steps: a first intermediate step and a second intermediate step, and wherein cross-sectional thickness of the first intermediate step is lesser than cross-sectional thickness of the second intermediate step; and the waveguide interface having an opening that partly covers the second opening of the transition aperture, the waveguide interface opening being offset relative to the second opening towards the third wall element such that a front step is formed on a part of the second main surface that falls within the waveguide interface opening.

8. An apparatus adapted to provide a signal transition between a substrate integrated waveguide (SIW) to a waveguide interface, the SIW comprising a dielectric material, a first metal layer, a second metal layer, and an electric wall element arrangement, the dielectric material having a layer thickness and being positioned between the first metal layer and the second metal layer, the electric wall element arrangement comprising a first electric wall element and a second electric wall element, the first electric wall element and the second electric wall element at least partly running mutually parallel, separated by an SIW width, in an SIW longitudinal extension and electrically connecting the first metal layer with the second metal layer, microwave signals being arranged to propagate along the SIW longitudinal extension in a confinement limited by at least the first metal layer, the second metal layer, the first electric wall element, and the second electric wall element, the apparatus comprising:

a coupling aperture in the first metal layer;

a third wall element running between the first electric wall element and the second electric wall element, across the SIW longitudinal extension;

an at least partly electrically conducting intermediate transition element comprising: a first main surface, a second main surface, and a transition aperture;

the transition aperture comprises a first opening with a first width in the first main surface, and a second opening with a second width in the second main surface, the first and second widths extending along the SIW longitudinal extension, wherein a transition from the first width to the second width takes place between the first opening and the second opening in two steps: a first intermediate step and a second intermediate step, wherein cross-sectional thickness of the first intermediate step is lesser than cross-sectional thickness of the second intermediate step; and the waveguide interface having an opening that partly covers the second opening of the transition aperture, the waveguide interface opening being offset relative to the second opening towards the third wall element such that a front step is formed on a part of the second main surface that falls within the waveguide interface opening, wherein the waveguide interface comprises a waveguide flange that is attached to the intermediate transition element by means of screws, and wherein the electric wall element arrangement comprises a plurality of via connections electrically connecting the first metal layer to the second metal layer.

* * * * *